US007215314B2

(12) United States Patent
Noguchi et al.

(10) Patent No.: US 7,215,314 B2
(45) Date of Patent: May 8, 2007

(54) SIGNAL TRANSMISSION CIRCUIT AND DISPLAY APPARATUS

(75) Inventors: Yukihiro Noguchi, Gifu (JP); Junka Kaya, Aichi (JP)

(73) Assignee: Sanyo Electronic Co., Ltd, Osaka (JP)

( * ) Notice: Subject to any disclaimer, the term of this patent is extended or adjusted under 35 U.S.C. 154(b) by 406 days.

(21) Appl. No.: 10/667,518

(22) Filed: Sep. 23, 2003

(65) Prior Publication Data

US 2004/0061693 A1 Apr. 1, 2004

(30) Foreign Application Priority Data

Sep. 27, 2002 (JP) ..... 2002-283397

(51) Int. Cl.
*G09G 3/36* (2006.01)

(52) U.S. Cl. ..... 345/100; 345/98

(58) Field of Classification Search ..... 345/98, 345/100, 204

See application file for complete search history.

(56) References Cited

U.S. PATENT DOCUMENTS

| | | | | |
|---|---|---|---|---|
| 5,151,689 | A * | 9/1992 | Kabuto et al. | 345/103 |
| 6,104,370 | A * | 8/2000 | Nakagaki et al. | 345/100 |
| 6,232,939 | B1 | 5/2001 | Saito et al. | |
| 6,377,235 | B1 * | 4/2002 | Murade et al. | 345/100 |
| 6,437,775 | B1 * | 8/2002 | Hanari | 345/204 |
| 6,680,721 | B2 * | 1/2004 | Murade et al. | 345/94 |
| 6,784,880 | B2 * | 8/2004 | Fujita et al. | 345/213 |
| 6,839,046 | B1 * | 1/2005 | Orisaka et al. | 345/98 |
| 7,006,067 | B2 * | 2/2006 | Tobita et al. | 345/92 |
| 7,042,433 | B1 * | 5/2006 | Kubota et al. | 345/100 |
| 2001/0040547 | A1 * | 11/2001 | Jinno et al. | 345/92 |

FOREIGN PATENT DOCUMENTS

| | | |
|---|---|---|
| JP | 6-138449 | 5/1994 |
| JP | 7-134562 | 5/1995 |
| JP | 10-74060 | 3/1998 |
| JP | 2000-29419 | 1/2000 |
| JP | P2000-131708 A | 5/2000 |

OTHER PUBLICATIONS

Japanese Office Action issued in corresponding Japanese Patent Application No. JP 2002-083397, dated Aug. 16, 2006.
Chinese Office Action issued in corresponding Chinese Patent Application No. CN 03160142.1, dated Oct. 27, 2006.

* cited by examiner

*Primary Examiner*—Sumati Lefkowitz
*Assistant Examiner*—Rodney Amadiz
(74) *Attorney, Agent, or Firm*—McDermott Will & Emery LLP

(57) ABSTRACT

A signal line drive circuit and a scanning line drive circuit are capable of being driven bidirectionally. A display apparatus includes a plurality of signal paths each of which transmit a signal outputted from a final-stage circuit thereof when the signal line circuit and/or the scanning line circuit is driven in a forward or reverse direction, and output paths formed by connecting the plurality of signal paths. There are provided a buffer unit and a switching element in each of the plurality of signal paths, and there is provided a buffer unit in each output path. Each of the switching elements in the plurality of signal paths is turned on according to a drive direction in the signal line drive circuit and/or the scanning line drive circuit, and then a target signal is selected and outputted to the output paths.

11 Claims, 5 Drawing Sheets

SIGNAL TRANSMISSION CIRCUIT AND DISPLAY APPARATUS

BACKGROUND OF THE INVENTION

1. Field of the Invention

The present invention relates to signal transmission circuits and display apparatus, and it particularly relates to a signal transmission circuit and display apparatus used when inspection signals are outputted therefrom.

2. Description of the Related Art

In recent years, the liquid crystal display (LCD) have been widely used as display apparatus for various electric machinery and apparatus, but the display considered promising as a next-generation flat display panel is the organic EL (Electro Luminescence) display. The display using the active matrix system as a display method for such displays is called the active matrix display. In the active matrix display, a multiplicity of pixels are vertically and horizontally disposed in a matrix, and a switching element is provided for each pixel. The group of pixels in the matrix is sequentially selected by the signal line drive circuit that drives the signal lines transmitting the luminance data and by the scanning line drive circuit that drives the scanning lines, so as to write the data thereto. For example, shift registers are used in these signal line drive circuit and scanning line drive circuit.

As the active matrix displays like this come to be widely used, there is a growing demand for the capability to switch the direction of data writing to the pixels thereof. For example, the way these displays are incorporated and implemented into the end products, which are mostly electrical equipment, varies with the type of the electrical equipment, and it is necessary to switch the direction of data writing according to how the display is to be incorporated.

Moreover, in various cameras with a built-in display, switching of data writing direction is required, for example, between normal display for the shots of normal objects and mirror-image display for the shots of the user himself/herself. In this case, there is also required the drive circuits that can switch the direction of data writing.

It is to meet these requirements that signal line drive circuits and scanning line drive circuits, which employ shift registers capable of transferring data in both directions, have been developed. Such circuits are disclosed, for example, in Japanese Patent Application Laid-Open No. Hei 10-74060.

The patent specifications, such as Japanese Patent Application Laid-Open No. 2000-131708, discloses a technique for checking signals outputted from the final stage of a shift register of a signal line drive circuit or a scanning line drive circuit in order to inspect for the operation state of the signal line drive circuits or the scanning line drive circuits of the matrix type display as mentioned above. In this way, it is possible to detect deterioration of transistors by checking the signals outputted from the final stage of a shift register.

Such inspection, however, has disadvantages in that the longer the distance between the final stage of a shift register and the connector pin, which is the inspection signal output terminal, the greater the distortion of the outputted signals will be due to the effect of wiring load. This disadvantage causes a problem where the inspection cannot be performed with desired accuracy. Especially with a signal line drive circuit or a scanning line drive circuit capable of switching the direction of data writing, signals from both the first stage and the final stage of the shift register need to be taken out as inspection signals. Normally, signal line drive circuits and scanning line drive circuits are disposed in the periphery of a display area, so that the first stages and the final stages of the shift registers are each positioned at a distance determined by the width and height of the display area. Accordingly, if the outputs from both the first stages and the final stages of shift registers of the signal line drive circuits and the scanning line drive circuits are to be taken out and received with accuracy, circuit design capable of properly correcting the distortion of the output signals needs to be carried out in light of the layout of these shift resistors and the output terminals thereof.

SUMMARY OF THE INVENTION

The present invention has been made in view of foregoing circumstances, and an object thereof is to provide a technology for obtaining desired output characteristics of signals by reducing the distortion of the signals outputted from a circuit element even when the wiring load is large. Another object of the present invention is to provide a technology for accurately taking out output signals from a circuit element in a display apparatus capable of switching the direction of data writing whichever is the direction in which data is written.

A preferred embodiment according to the present invention relates to a signal transmission circuit. This circuit includes: a plurality of signal paths which transmit signals outputted from a plurality of different circuit elements; and an output path formed by connecting the plurality of signal paths, wherein each of the plurality of signal paths includes a buffer element and a switching element which receives an output from the buffer element, the output path is formed by connecting output lines of the switching elements, there is disposed a buffer element in the output path, and wherein any of the switching elements in the plurality of signal paths is turned on according to an operational mode, and then a target signal is selected and outputted to the output path.

By implementing the above structure, the signals outputted from the different circuit elements are outputted to the output path via the buffer element disposed in the signal path. Thus, even if the distance from each circuit element to the output path is long, the distortion of the signal characteristics caused by the wiring load can be corrected in the respective signal paths. Moreover, the distortion of the output signal characteristics caused by the wiring load can be corrected in the output path, too, by having the signal pass through the buffer element again.

Here, the buffer elements might be disposed in a dispersed manner so that the target signal might obtain a desired output characteristic by passing through both the buffer elements provided in the plurality of signal paths and the buffer element provided in the output path. By this arrangement where the buffer elements are disposed in the dispersed and scattered manner, the size of the respective buffer elements can be made smaller.

Here, each of the different circuit elements may be one corresponding to a final-stage circuit element in a block which sequentially drives a plurality of pixel circuits, when the pixel circuits are driven in a forward or reverse direction, and the operational mode may be switched corresponding to the forward or reverse direction in driving the pixel circuits. Thereby, even if the signals are outputted from the first- or last-stage circuit element in the signal transmission circuit capable of driving in both forward and reverse directions, the distortion of the output characteristics of the signals caused by the wiring load can be corrected.

Another preferred embodiment according to the present invention relates to a display apparatus. This apparatus includes: a plurality of pixel circuits; a circuit block which sequentially drives the plurality of pixel circuits; a plurality of signal paths that transmit signals outputted from circuit elements in the circuit block, which respectively correspond to a final stage of the circuit block when the pixel circuits are driven in a forward or reverse direction; and an output path formed by connecting the plurality of signal paths, wherein each of the plurality of signal paths includes a buffer element and a switching element which receives an output from the buffer element, the output path is formed by connecting output lines of the switching elements, there is disposed a buffer element in the output path, and wherein any of the switching elements in the plurality of signal paths is turned on according to a drive direction in the circuit block, and then a target signal is selected and outputted to the output path.

By implementing the above-mentioned structure, even in a case of the writing in any direction in the display apparatus capable of writing data in both forward and reverse directions, the output signal from the final-stage circuit element can be obtained so that the distortion of the output signal characteristics caused by the wiring load can be corrected and the output signal has a desired output characteristic.

Here, the buffer elements might be disposed in a dispersed manner so that the target signal might obtain a desired output characteristic by passing through both the buffer elements provided in the plurality of signal paths and the buffer element provided in the output path. By this arrangement where the buffer elements are disposed in the dispersed and scattered manner, the size of the respective buffer elements can be made smaller.

Still another preferred embodiment according to the present invention relates to a signal transmission circuit. This circuit includes a signal path up to a connector pin from a circuit element disposed at a final stage of a circuit block which sequentially drives a plurality of pixel circuits, wherein a buffer element disposed in the vicinity of the circuit element and a buffer element disposed in the vicinity of the connector pin are provided in the signal path, and wherein the plurality of buffer elements necessary for a signal to be transmitted to finally have a desired output characteristic are disposed in a dispersed manner.

By implementing the above structure, even if the connector pin is disposed at a distance far from the final-stage circuit element, the output signal having the desired output characteristics can be obtained from the circuit element by correcting the distortion of the signal characteristics caused by the wiring load.

It is to be noted that any arbitrary combination of the above-described structural components and expressions changed between a method, an apparatus, a system, a computer program, a recording medium and so forth are all effective as and encompassed by the present embodiments.

Moreover, this summary of the invention does not necessarily describe all necessary features so that the invention may also be sub-combination of these described features.

DETAILED DESCRIPTION OF THE INVENTION

The invention will now be described based on the following embodiments which do not intend to limit the scope of the present invention but exemplify the invention. All of the features and the combinations thereof described in the embodiments are not necessarily essential to the invention.

In the following embodiments, examples are described where the present invention is applied to display apparatus. And what may be assumed here as the display apparatus is an active matrix organic EL display.

First Embodiment

In a first embodiment, described is a case where the present invention is applied to a display apparatus capable of switching the direction of data writing.

Figure 1:
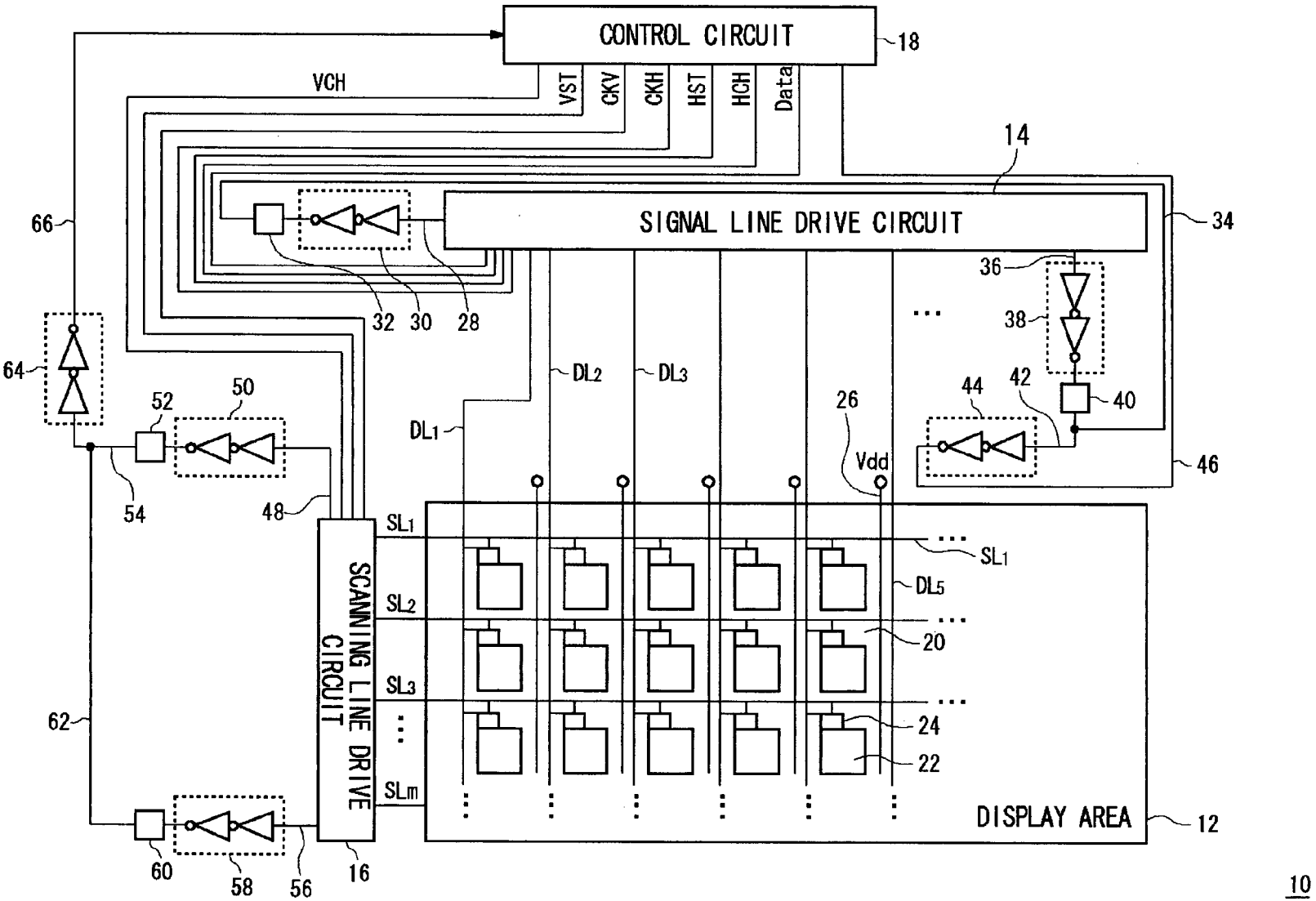
FIG. 1 is a plan view of a display apparatus according to a first embodiment of the present invention.

FIG. 1 is a plan view of a display apparatus according to the first embodiment of the present invention. A display apparatus 10 includes a display area 12, a signal line drive circuit 14, a scanning line drive circuit 16 and a control circuit 18.

The display area 12 includes a plurality of pixels 20 arranged in a matrix of m rows by n columns. Each pixel 20 includes an optical element 22 and a pixel circuit 24 therefor within it. Here, the optical element 22 is an organic light emitting diode (OLED), which functions as a luminous element. The detail of the pixel 20 will be described later.

In the display area 12, the pixels 20 in the first row are connected to a first scanning line $SL_1$, the pixels 20 in the second row are connected to a second scanning line $SL_2$, and the pixels 20 in the subsequent rows are connected to their corresponding scanning lines. Similarly, the pixels 20 in the first column are connected to a first signal line $DL_1$, the pixels 20 in the second column are connected to a second signal line $DL_2$, and the pixels 20 in the subsequent columns are connected to their corresponding signal lines.

The signal line drive circuit 14 drives each of n signal lines. The scanning line drive circuit 16 drives each of m scanning lines. The signal line drive circuit 14 and the scanning line drive circuit 16 according to this embodiment, of which a detailed description will be given later, each include a bidirectional shift register.

The control circuit 18, in order to operate each shift register included in the signal line drive circuit 14 and the scanning line drive circuit 16, supplies the signal line drive circuit 14 with a horizontal clock signal CKH and a horizontal start signal HST, and supplies the scanning line drive circuit 16 with a vertical clock signal CKV and a vertical start signal VST. Moreover, the control circuit 18, in order to switch the shift direction of each shift register included in the signal line drive circuit 14 and the scanning line drive circuit 16, supplies the signal line drive circuit 14 with a horizontal shift direction switching signal HCH, and supplies the scanning line drive circuit 16 with a vertical shift direction switching signal VCH. Where the horizontal shift direction switching signal HCH and the vertical shift direction switching signal VCH indicate a forward direction in FIG. 1, the signal lines are selected successively rightward, and the scanning lines are selected successively downward. On the other hand, where the horizontal shift direction switching signal HCH and the vertical shift direction switching signal VCH indicate the reverse direction in FIG. 1, the signal lines are selected successively leftward, and the scanning lines are selected successively upward. Moreover, the control circuit 18 supplies an image signal Data to the signal line drive circuit 14. A plurality of lines to supply the image signal Data may be provided for each of the red (R), green (G) and blue (B), which are emitted by the optical element 22 of each pixel 20. It is to be noted here that, according to this embodiment, what is represented as a control circuit 18 in FIG. 1 is a connector pin that supplies the above-mentioned various signals to the signal line drive circuit 14 and the scanning line drive circuit 16.

The display apparatus 10 includes a first signal path 28 and a third signal path 36, which transmit signals outputted from two different circuit elements of the signal line drive circuit 14, a second signal path 34 connected to the first signal path 28 via a first buffer unit 30 and a first switching element 32, and a fourth signal path 42 connected to the third signal path 36 via a second buffer unit 38 and a second switching element 40. The second signal path 34 and the fourth signal path 42 are coupled to each other. The display apparatus 10 further includes a first output path 46 connected to the second signal path 34 and the fourth signal path 42 via a third buffer unit 44. The first output path 46 is connected to the control circuit 18, and an inspection signal from the signal line drive circuit 14 is taken out therethrough. Here the first signal path 28 takes out and carries an output signal from a circuit element of the first stage of the shift register, in the signal line drive circuit 14, that drives the first signal line $DL_1$. Moreover, the third signal path 36 takes out and carries an output signal from a circuit element of the final stage of the shift register, in the signal line drive circuit 14, that drives the n-th signal line $DL_n$.

The display apparatus 10 includes a fifth signal path 48 and a seventh signal path 56, which transmits signals outputted from two different circuit elements of the scanning line drive circuit 16, a sixth signal path 54 connected to the fifth signal path 48 via a fourth buffer unit 50 and a third switching element 52, and an eighth signal path 62 connected to the seventh signal path 56 via a fifth buffer unit 58 and a fourth switching element 60. The sixth signal path 54 and the eighth signal path 62 are coupled to each other. The display apparatus 10 further includes a second output path 66 connected to the sixth signal path 54 and the eighth signal path 62 via a sixth buffer unit 64. The second output path 66 is connected to the control circuit 18, and an inspection signal from the scanning line drive circuit 16 is taken out therethrough. Here the fifth signal path 48 takes out and carries an output signal from the circuit element of the first stage of the shift register, in the scanning line drive circuit 16, that drives the first scanning line $SL_1$. Moreover, the seventh signal path 56 takes out and carries an output signal from the circuit element of the final stage of the shift register, in the scanning line drive circuit 16, that drives the n-th scanning line $SL_n$.

Here the first buffer unit 30, the second buffer unit 38, the third buffer unit 44, the fourth buffer unit 50, the fifth buffer unit 58 and the sixth buffer unit 64 can each be constituted by a plurality of buffer elements, such as inverters. While the number of inverters in these buffer units is not limited to any specific number, the total number of inverters included in the first buffer unit 30 and the third buffer unit 44 and that of inverters included in the second buffer unit 38 and the third buffer unit 44 are each set to be an even number. Moreover, the total number of inverters included in the fourth buffer unit 50 and the sixth buffer unit 64 and that of inverters included in the fifth buffer unit 58 and the sixth buffer unit 64 are each set to be an even number. Moreover, it is preferable that the inverters in these buffer units are structured so that they have greater fan-out as they are located closer to the control circuit 18. The buffer units 30, 38, 44, 50, 58 and 64 may also be structured using ordinary buffer elements of positive logic and, in this case, the number of the buffer elements on a single path may not have to be an even number. It is desirable that the first and second buffer units 30 and 38 as well as the fourth and fifth buffer units 50 and 58 be adjusted properly so as to have a substantially uniform characteristic therebetween such as a drive capability thereof. Thereby, the inspection signals having the same waveforms can be obtained irrespective of the driving direction of the pixel circuits.

The first switching element 32 and the second switching element 40 may be structured, for instance, with transistors whose on and off are switched complementarily. A structure may be such that a horizontal shift direction switching signal HCH is inputted to the first switching element 32 and the second switching element 40, and their on and off can be switched. Similarly, the third switching element 52 and the fourth switching element 60 may be structured, for instance, with transistors whose on and off are switched complementarily. A structure may be such that a vertical shift direction switching signal VCH is inputted to the third switching element 52 and the fourth switching element 60, and their on and off can be switched.

Figure 2:
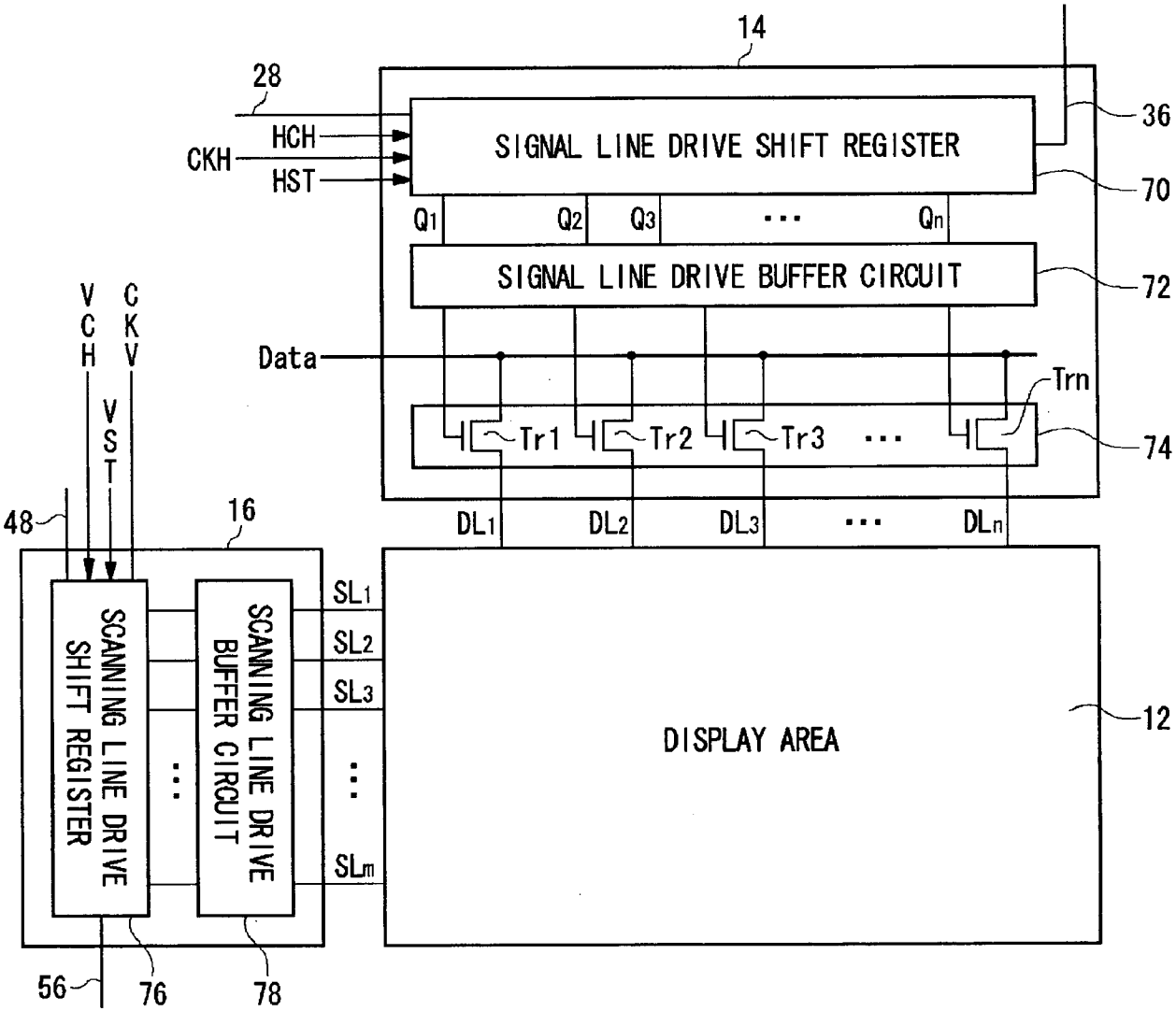
FIG. 2 shows an example of internal structure of a signal line drive circuit and a scanning line drive circuit shown in FIG. 1.

FIG. 2 shows an example of internal structure of the signal line drive circuit 14 and the scanning line drive circuit 16 shown in FIG. 1. The signal line drive circuit 14 includes a signal line drive shift register 70, a signal line drive buffer circuit 72 and a switching circuit 74.

Figure 3:
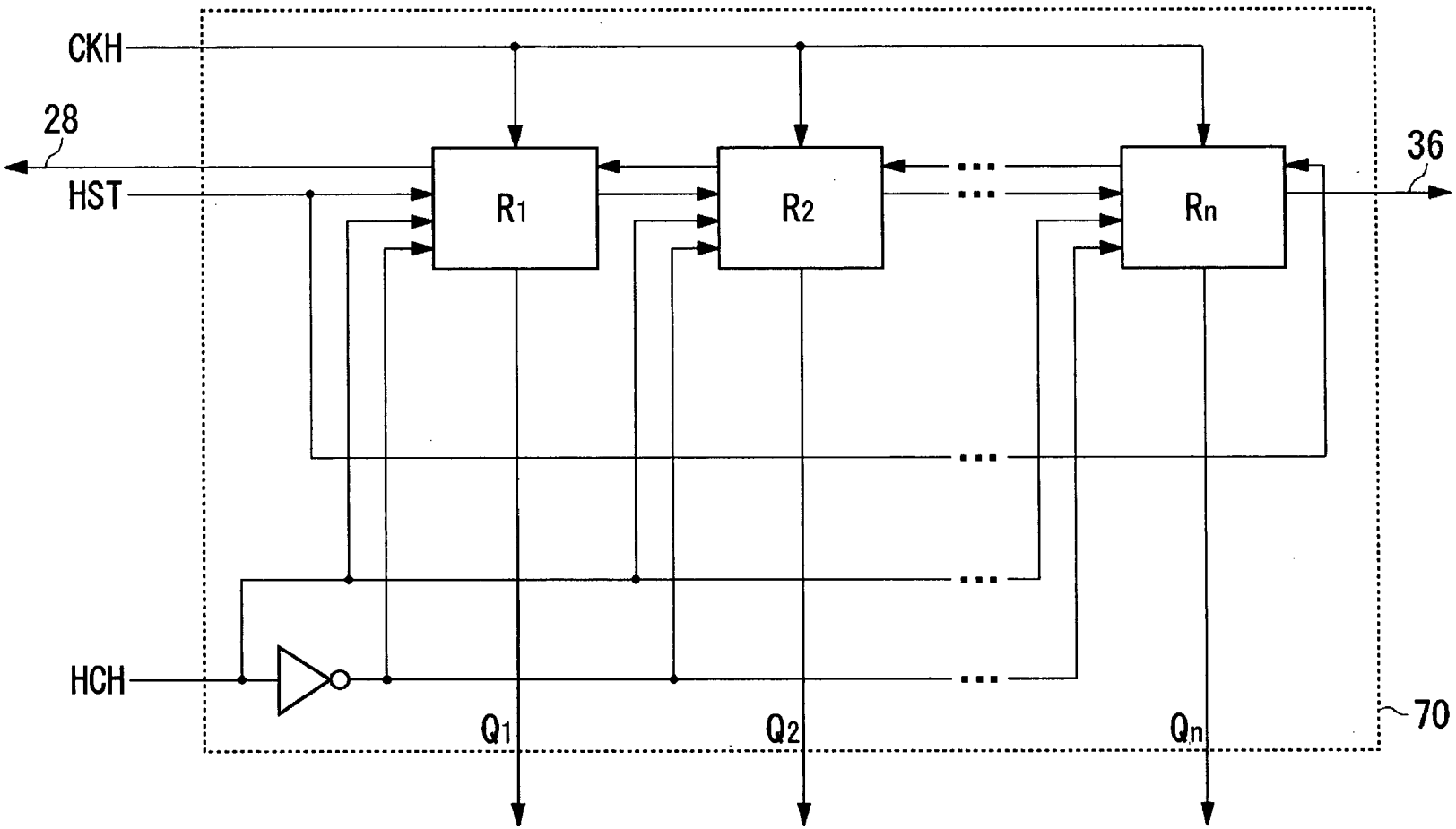
FIG. 3 shows an example of an internal structure of a signal line drive shift register shown in FIG. 2.

FIG. 3 shows an example of an internal structure of the signal line drive shift register 70 shown in FIG. 2. The signal line drive shift register 70 includes first to n-th signal line register circuits $R_1$ to $R_n$ corresponding to the same numbered columns of the pixels in the display area 12. Here signal line register circuits $R_1$ to $R_n$ may be structured, for example, with a flip-flop circuit or a latch circuit. The horizontal clock signal CKH is inputted to each of the signal line register circuits $R_1$ to $R_n$. The horizontal start signal HST is inputted to the first signal line register circuit $R_1$ at the first stage and the n-th signal line register circuit $R_n$ at the final stage. Furthermore, the horizontal shift direction switching signal HCH is inputted to each of the signal line register circuits $R_1$ to $R_n$.

Each of the signal line register circuits $R_1$ to $R_n$ shifts the horizontal start signal HST in the direction corresponding to the horizontal shift direction switching signal HCH in synchronism with the horizontal clock signal CKH.

For example, when the horizontal shift direction switching signal HCH indicates a forward direction, a high horizontal start signal HST is inputted to the first signal line register circuit $R_1$. In this case, each of the signal line register circuits $R_1$ to $R_n$ sequentially outputs the high signal to the subsequent signal line register circuit. In this row, a high signal from the n-th signal line register circuit $R_n$ at the final stage is outputted to the third signal path 36.

On the other hand, when the horizontal shift direction switching signal HCH indicates a reverse direction, a high horizontal start signal HST is inputted to the n-th signal line register circuit $R_n$. In this case, each of the signal line register circuits $R_n$ to $R_1$ sequentially outputs a high signal to the subsequent signal line register circuit. In this row, a high signal from the first signal line register circuit $R_1$ at the first stage is outputted to the first signal path 28.

With the high signal inputted, the signal line register circuits $R_1$ to $R_n$ output the high signal to their respective signal lines $Q_1$ to $Q_n$ in synchronism with the horizontal clock signal CKH.

Referring back to FIG. 2, the switching circuit 74 includes first to n-th transistors Tr1 to Trn corresponding to the same numbered columns of the pixels in the display area 12. To the drain electrodes (source electrodes) of the first to n-th transistors Tr1 to Trn, luminance data are inputted from a data line Data. High signals outputted from the signal line drive shift register 70 are impressed to the gates of the first to n-th transistors Tr1 to Trn via the signal line drive buffer circuit 72. Thereby, the first to n-th transistors Tr1 to Trn turn on successively. When the first to n-th transistors Tr1 to Trn are turned on, the luminance data flow through the corresponding first to n-th signal lines $DL_1$ to $DL_n$.

The scanning line drive circuit 16 includes a scanning line drive shift register 76 and a scanning line drive buffer circuit 78. The scanning line drive shift register 76 includes m scanning line register circuits corresponding to the number of rows of the pixels in the display area 12. In the scanning line drive shift register 76, just as well as in the signal line drive shift register 70, the vertical clock signal CKV is inputted to each of the scanning line register circuits. The vertical start signal VST is inputted to the scanning line register circuit at the first stage and the scanning line register circuit at the final stage. Moreover, a vertical shift direction switching signal VCH is inputted to each of the scanning line register circuits. Each of the scanning line register circuits shifts the vertical start signal VST in the direction corresponding to the vertical shift direction switching signal VCH in synchronism with the vertical clock signal CKV. As a high vertical start signal VST is inputted to the scanning line register circuit at the first stage or the final stage, each of the scanning line register circuits sequentially outputs a high signal to the subsequent scanning line register circuit in the forward or reverse direction. The scanning line register circuits, with high signals inputted, output high signals to their respective scanning lines $SL_1$ to $SL_n$ in synchronism with the vertical clock signal CKV. At this time, the high signal from the scanning line register circuit at the final stage or the first stage is outputted to the seventh signal path 56 or the fifth signal path 48.

Figure 4:
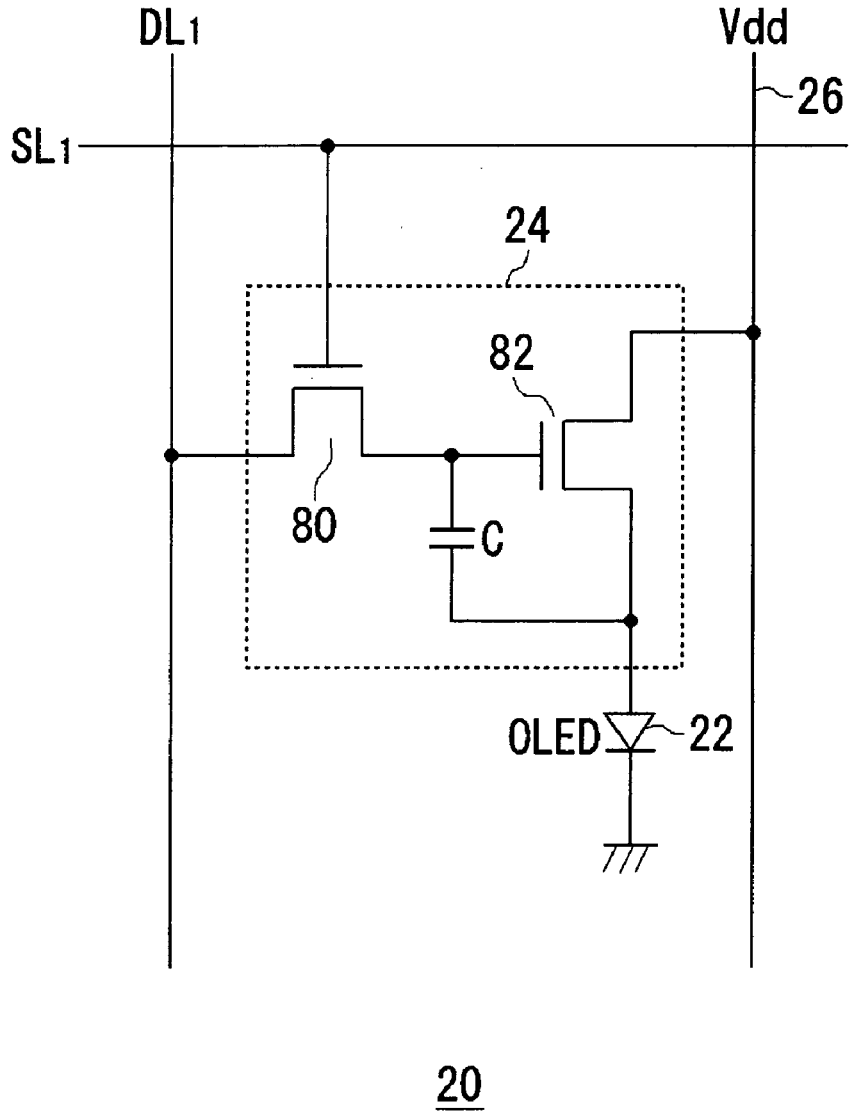
FIG. 4 is a circuit diagram showing a structure of a pixel shown in FIG. 1.

FIG. 4 is a circuit diagram showing a structure of the pixel 20 shown in FIG. 1. The pixel 20 includes a pixel circuit 24 and an optical element 22. The pixel circuit 24 includes a switching transistor 80 which is a thin film transistor (hereinafter simply referred to as "transistor"), a driving transistor 82 which drives the optical element 22, and a capacitance C.

A gate electrode of the switching transistor 80 is connected to a first scanning line $SL_1$, a drain electrode (or source electrode) of the switching transistor 80 is connected to a first signal line $DL_1$, and the source electrode (or drain electrode) of the switching transistor 80 is connected to a gate electrode of the driving transistor 82 and one of the electrodes of the capacitance C. The other of the electrodes of the capacitance C is connected to a source electrode of the driving transistor 82.

The source electrode of the driving transistor 82 is connected to an anode of the optical element 22, and the drain electrode of the driving transistor 82 is connected to a power supply line 26, so that a voltage Vdd is impressed to cause the optical element 22 to emit light.

The optical element 22 includes a luminescent element layer held between the anode and the cathode thereof. The anode of the optical element 22 is connected to the source electrode of the driving transistor 82, and the cathode is grounded.

Next, operations of the display apparatus 10 according to the present embodiment will be described with reference to FIGS. 1 to 4. First, operation where the signal lines are driven in a forward direction will be described. In this case, in the signal line drive circuit 14, a high horizontal start signal HST is first inputted to the first signal line register circuit $R_1$. Similarly in the scanning line drive circuit 16, a high vertical start signal VST is inputted to the scanning line register circuit at the first stage. As a result, the high signal is outputted from both the first signal line register circuit $R_1$ and the scanning line register circuit at the first stage, and thus desired luminance data is outputted to the first signal line $DL_1$ while the high signal is outputted to the first scanning line $SL_1$. Thus, a pixel 20 in the position where the first signal line $DL_1$ and the first scanning line $SL_1$ intersect with each other is selected, and luminance data is written in the optical element 22 of the pixel 20.

Thereafter, the pixels in the first row are selected successively rightward. When the n-th signal line register circuit $R_n$ in the final column is selected and a next horizontal clock signal CKH is inputted, the n-th signal line register circuit $R_n$ outputs a high signal to the third signal path 36. The high signal outputted by the third signal path 36 is amplified at the second buffer unit 38. At this time, the second switching element 40 is on, so that this signal is inputted to the third buffer unit 44 through the second switching element 40 and the fourth signal path 42 and, after further amplification, is outputted from the control circuit 18 via the first output path 46.

Moreover, with the timing of a horizontal start signal HST inputted to the first signal line register circuit $R_1$, a horizontal start signal HST is inputted again to the first signal line register circuit $R_1$. A structure may be such that at this time the high signal from the n-th signal line register circuit $R_n$ is inputted again to the first signal line register circuit $R_1$.

With a similar timing, in the scanning line drive circuit 16, a high signal is outputted to the scanning line register circuit at the second stage. Thereafter, the pixels in the second row are selected successively rightward in the similar manner as with the pixels in the first row. Upon completion of writing of luminance data to the pixels in the second row, the same processing goes on to the third, the fourth and subsequent rows until luminance data are written to the pixels in the final m-th row.

When the scanning line register circuit at the final stage is selected and a next vertical clock signal CKV is inputted, the scanning line register circuit at the final stage outputs a high signal to the seventh signal path 56. The high signal outputted to the seventh signal path 56 is amplified at the fifth buffer unit 58. At this time, the fourth switching element 60 is on, so that this signal is inputted to the sixth buffer unit 64 through the fourth switching element 60 and the eighth signal path 62 and, after further amplification, is taken out and outputted from the control circuit 18 via the second output path 66.

Next, operation where the signal lines are driven in a reverse direction will be described. In this case, in the signal line drive circuit 14 and the scanning line drive circuit 16, a high horizontal start signal HST and a high vertical start signal VST are inputted to the n-th signal line register circuit $R_n$ at the final stage and the scanning line register circuit at the final stage, respectively. As a result, the high signals are outputted from both the n-th signal line register circuit $R_n$ and the scanning line register circuit at the final stage, and thus desired luminance data is outputted to the n-th signal line $DL_n$ while the high signal is outputted to the m-th scanning line $SL_m$. Thus, a pixel 20 in the position where the n-th signal line $DL_n$ and the mth scanning line $SL_m$ intersect with each other is selected, and luminance data is written in the optical element 22 of the pixel 20.

Thereafter, the pixels in the m-th row are selected successively leftward. When the first signal line register circuit $R_1$ at the first stage is selected and a next horizontal clock signal CKH is inputted, the first signal line register circuit $R_1$ outputs a high signal to the first signal path 28. The high signal outputted by the first signal path 28 is amplified at the first buffer unit 30. At this time, the first switching element 32 is on, so that this signal is inputted to the third buffer unit 44 through the first switching element 32 and the second signal path 34 and, after further amplification, is taken out and outputted from the control circuit 18 via the first output path 46.

Thereafter, conversely to where the signal lines are driven in the forward direction, the similar processing is performed in a reverse direction along the (m−1)th, the (m−2)th and subsequent rows until writing is done to the pixels in the first row of the first stage.

When the first scanning line register circuit at the first stage is selected and a next vertical clock signal CKV is inputted, the scanning line register circuit at the first stage outputs a high signal to the fifth signal path 48. The high signal outputted to the fifth signal path 48 is amplified at the fourth buffer unit 50. At this time, the fourth switching element 52 is on, so that this signal is inputted to the sixth buffer unit 64 through the fourth switching element 52 and the sixth signal path 54 and, after further amplification, is taken out and outputted from the control circuit 18 via the second output path 66.

Now, referring to FIG. 4, operation of the pixel 20 when the first signal line $DL_1$ and the first scanning line $SL_1$ are selected will be described. First, the first scanning line $SL_1$ is selected to turn the switching transistor 80 on, and then data potential is given to the first signal line $DL_1$. At this time, the potential at the electrode of the capacitance C rises. At the same time, the potential at the gate electrode of the driving transistor 82 undergoes a transition the same way as the potential at the electrode of the capacitance C.

As the potential at the gate electrode of the driving transistor 82 rises to and above a predetermined level, current corresponding to the voltage flows from the power supply line 26 to the optical element 22, thereby causing the optical element 22 to emit light. Even when the first scanning line $SL_1$ is not selected, the gate potential of the driving transistor 82 is retained, so that the optical element 22 keeps emitting light with a luminance corresponding to the data potential impressed to the gate electrode of the driving transistor 82.

As described above, in a display apparatus according to the present embodiment, whether a signal is outputted from the first stage or the final stage of a signal line drive circuit 14, the signal value is amplified by the first buffer unit 30 or the second buffer unit 40 and then further amplified by the third buffer unit 44, so that the distortion of the signal waveform can be reduced even for large interconnection load. Moreover, by a similar processing, the distortion of signal waveform can also be reduced for the output from a scanning line drive circuit 16.

Second Embodiment

A second embodiment of the present invention as applied to a display apparatus wherein the direction of data writing is fixed will now be described.

Figure 5:
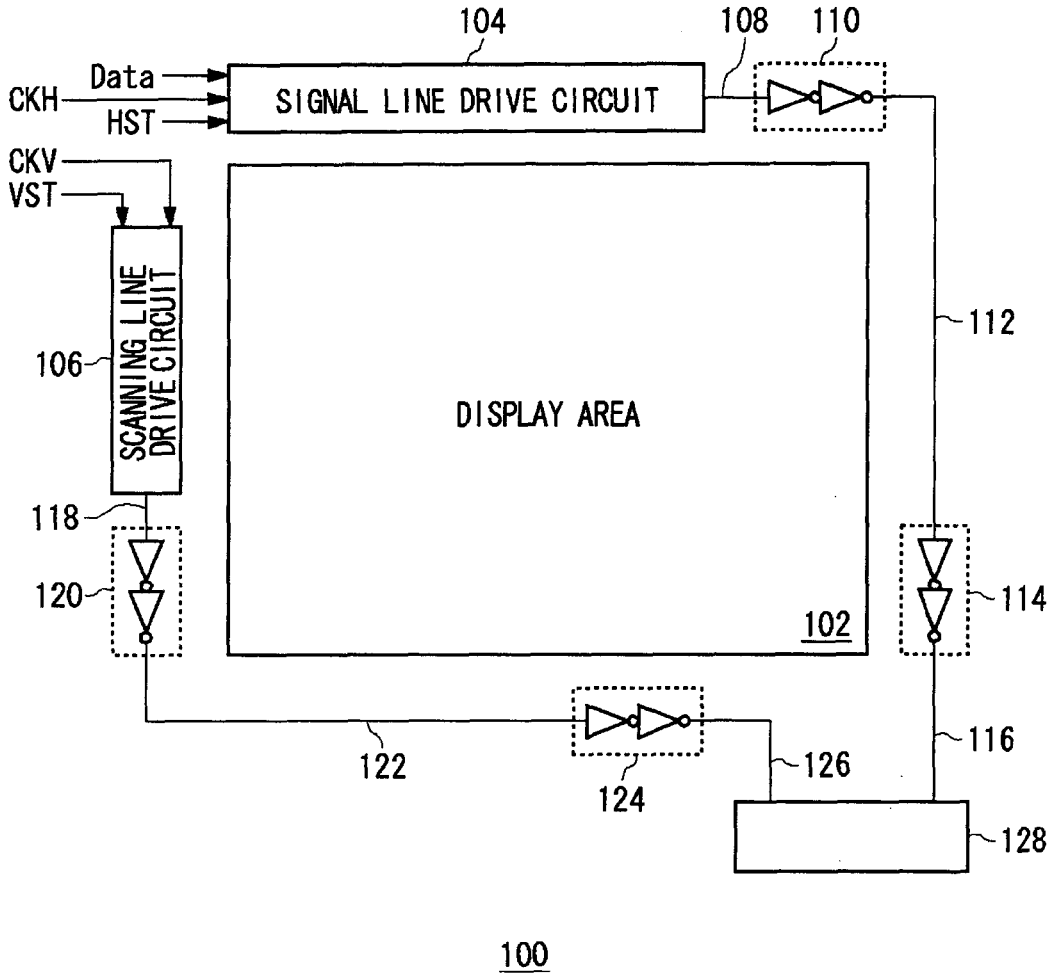
FIG. 5 is a plan view of a display apparatus according to a second embodiment of the present invention.

FIG. 5 is a plan view of a display apparatus according to the second embodiment of the present invention. A display apparatus 100 includes a display area 102, a signal line drive circuit 104, a scanning line drive circuit 106 and a control circuit 128. Here, the signal line drive circuit 104 and the scanning line drive circuit 106 include a plurality of circuit elements, respectively, in the similar manner to with the signal line drive circuit 14 and the scanning line drive circuit 16 according to the first embodiment. In this embodiment, the plurality of circuit elements are register circuits that shift in a single direction only.

The display apparatus 100 includes a ninth signal path 108 which takes out and transports signals outputted from the circuit element at the final stage of the signal line drive circuit 104, a tenth signal path 112 connected to the ninth signal path 108 via a seventh buffer unit 110, and a third output path 116 connected to the tenth signal path 112 via an eighth buffer unit 114. Furthermore, the display apparatus 100 includes an eleventh signal path 118 which takes out and transports signals outputted from the circuit element at the final stage of the scanning line drive circuit 106, a twelfth signal path 122 connected to the eleventh signal path 118 via a ninth buffer unit 120, and a fourth output path 126 connected to the twelfth signal path 122 via a tenth buffer unit 124. The third output path 116 and the fourth output path 126 are connected to the control circuit 128, and inspection signals are derived from the signal line drive circuit 104 and the scanning line drive circuit 106, respectively.

Here, the seventh buffer unit 110 is provided close to the signal line drive circuit 104, and the eighth buffer unit 114 is provided close to the control circuit 128. In this manner, a plurality of buffer units 110 and 114 are disposed in a scattered manner on the path from the register circuit at the final stage of the signal line drive circuit 104 to the control circuit 128, so that it is possible to obtain the output signal from the signal line drive circuit 104 that has desired output characteristics. The same is true for the output signal from the scanning line drive circuit 106.

Though not shown in the figure, the control circuit 128 supplies a horizontal clock signal CKH, a horizontal start signal HST and an image signal Data to the signal line drive circuit 104, and it also supplies a vertical clock signal CKV and a vertical start signal VST to the scanning line drive circuit 106. In this embodiment, too, what is represented by a control circuit 128 in FIG. 5 is a connector pin that supplies the various above-mentioned signals to the signal line drive circuit 104 or the scanning line drive circuit 106.

By implementing the display apparatus according to the present embodiment, the distortion of the signal waveform may be reduced even when the distance from the final stage of the signal line drive circuit 104 to the control circuit 128 is long and thus the interconnection load is large.

The present invention has been described based on the embodiments which are only exemplary. It is understood by those skilled in the art that there exist other various modifications to the combination of each component and process described above and that such modifications are encompassed by the scope of the present invention. Such modifications will be described hereinbelow.

The switching transistor as shown in FIG. 4 may be two or more transistors connected in series. In such a configuration, the characteristics of the transistors, such as a current amplification factor, may be set to differ from one another. For example, the current amplification factor of a transistor closer to the driving transistor may be set lower to reduce leakage current.

Moreover, the characteristics of these switching transistors and drive transistors may be set to differ from each other. For example, when the current amplification factor of a driving transistor is set low, the range of setting data corresponding to the same luminance range becomes wider, thus making the control of luminance easier.

The present invention is not limited to display apparatus, but can be widely applied to apparatus using shift registers, for instance. Moreover, though an active matrix type organic EL display is assumed as a display apparatus in the description of the preferred embodiments, an LCD may be used as the display apparatus.

Although in the description of the above embodiments an example is used where the detection signals are derived from both the signal line drive circuit and scanning line drive circuit, a structure may be used where the detection signal is derived from either one of them only.

Although the present invention has been described by way of exemplary embodiments, it should be understood that many changes and substitutions may further be made by those skilled in the art without departing from the scope of the present invention which is defined by the appended claims.

What is claimed is:

1. A signal transmission circuit, including:

a plurality of signal paths which respectively transmit signals outputted from a plurality of different circuit elements; and an output path formed by connecting the plurality of signal paths, wherein each of the plurality of signal paths includes a buffer element and a switching element which receives an output from the buffer element, the output path is formed by connecting output lines of the switching elements, there is disposed a buffer element in the output path, and wherein any of the switching elements in the plurality of signal paths is turned on according to an operational mode, and then a target signal is selected and outputted to the output path, and wherein each of the different circuit elements is one corresponding only to a final-stage circuit element in a block which sequentially drives a plurality of pixel circuits, when the pixel circuits are driven in a forward or reverse direction, and the operational mode is switched corresponding to the forward or reverse direction of driving the pixel circuits.

2. A signal transmission circuit according to claim 1, wherein the buffer elements are disposed in a dispersed manner so that the target signal might obtain a desired output characteristic by passing through both the buffer elements provided in the plurality of signal paths and the buffer element provided in the output path.

3. A signal transmission circuit according to claim 1, further including a signal path up to a connector pin from the final-stage circuit element, wherein the buffer element disposed in the vicinity of the circuit element and the buffer element disposed in the vicinity of the connector pin are provided in the signal path, and wherein the plurality of buffer elements necessary for a signal to be transmitted to finally have a desired output characteristic are disposed in a dispersed manner.

4. A display apparatus, including:

a plurality of pixel circuits;

a circuit block which sequentially drives the plurality of pixel circuits;

a plurality of signal paths that transmit signals outputted from circuit elements in the circuit block which respectively correspond to a final stage of the circuit block, when the pixel circuits are driven in a forward or reverse direction; and an output terminal that outputs a checking signal to be used for inspecting an operation state of the circuit block, the output terminal disposed between the pixel circuits and the circuit block in an output path formed by connecting the plurality of signal paths, wherein each of the plurality of signal paths includes a buffer element and a switching element which receives an output from the buffer element, the output path is formed by connecting output lines of the switching elements, there is disposed a buffer element in the output path between the final stage of the circuit block and the output terminal, and wherein any of the switching elements in the plurality of signal paths is turned on according to a drive direction in the circuit block, and then a target signal is selected and outputted to the output path.

5. A display apparatus according to claim 4, wherein the circuit block is a circuit which drives a data signal line for writing data to the plurality of pixel circuits.

6. A display apparatus according to claim 5, wherein the circuit block is a shift register, and the plurality of signal paths transmit signals outputted from a final-stage of the shift register.

7. A display apparatus according to claim 4, wherein the circuit block is a circuit which drives a scanning line for writing data to the plurality of pixel circuits.

8. A display apparatus according to claim 7, wherein the circuit block is a shift register, and the plurality of signal paths transmit signals outputted from a final-stage of the shift register.

9. A display apparatus according to claim 4, wherein the buffer elements are disposed in a dispersed manner so that the target signal obtains a desired output characteristic by passing through both the buffer elements provided in the plurality of signal paths and the buffer element provided in the output path.

10. A display apparatus according to claim 4, wherein the buffer elements provided in the plurality of signal paths are adjusted so as to have a substantially uniform characteristic therebetween.

11. A display apparatus according to claim 4, further including a signal path up to a connector pin from the final-stage circuit in the circuit block, wherein the buffer element disposed in the vicinity of the circuit element and the buffer element disposed in the vicinity of the connector pin are provided in the signal path, and wherein the plurality of buffer elements necessary for a signal to be transmitted to finally have a desired output characteristic are disposed in a dispersed manner.

* * * * *